United States Patent [19]

Heimberg

[11] 4,142,570

[45] Mar. 6, 1979

[54] WINDOW CURTAIN HAVING WEIGHT-RECEIVING POCKETS

[75] Inventor: Eli Heimberg, North Dartmouth, Mass.

[73] Assignee: Cameo Curtains, Inc., New York, N.Y.

[21] Appl. No.: 808,855

[22] Filed: Jun. 22, 1977

[51] Int. Cl.[2] ..... A47H 1/00

[52] U.S. Cl. ..... 160/349 R

[58] Field of Search ..... 160/349 R, 349 D

[56] References Cited

U.S. PATENT DOCUMENTS

| | | | |
|---|---|---|---|
| 1,828,678 | 10/1931 | Peterman et al. | 160/349 |
| 1,936,198 | 11/1933 | Kirsch | 160/349 |
| 2,272,656 | 2/1942 | Byron | 160/349 |
| 2,303,502 | 12/1942 | Rous | 160/349 |
| 3,224,495 | 12/1965 | Truesdale | 160/349 |

*Primary Examiner*—Peter M. Caun

*Attorney, Agent, or Firm*—Alan H. Levine

[57] ABSTRACT

A window curtain comprising a textile fabric panel which, for the most part, is of single layer thickness. The panel is formed of a sheer translucent fabric. The panel has a plurality of vertical fabric edges, such as side edges and possibly edges of margins overlapped to form a seam or seams between separate pieces joined to form the panel. A pocket is fixed to the panel near the lower end of each vertical fabric edge, and nowhere else. Each pocket has an opening through which a weight can be inserted into, and removed from, the pocket. The panel has a bottom hem, and the pocket is located no higher than the upper edge of the bottom hem.

9 Claims, 4 Drawing Figures

FIG. 1
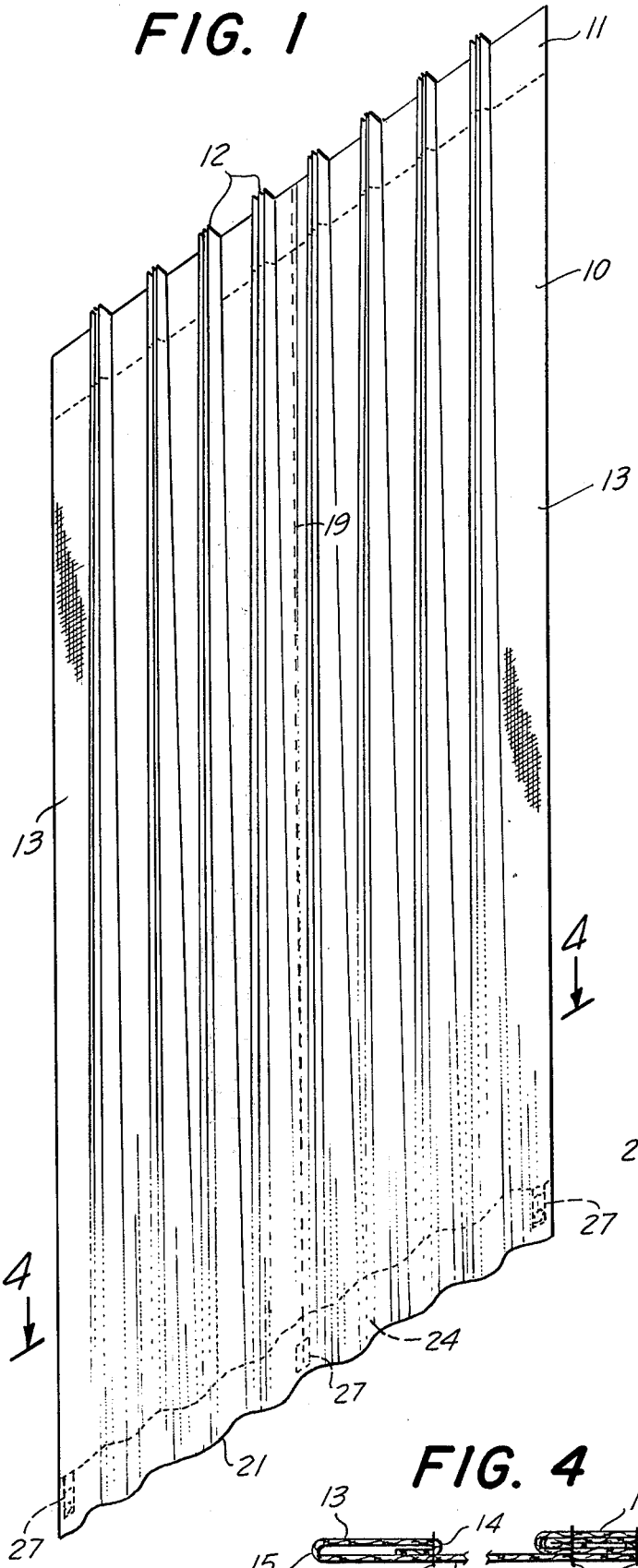
FIG. 2
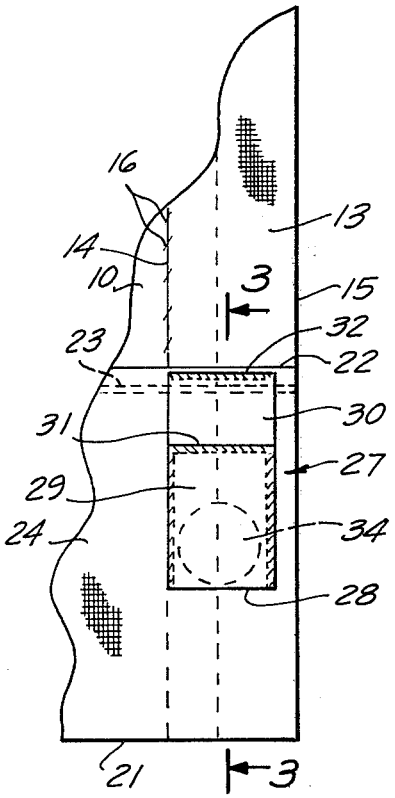
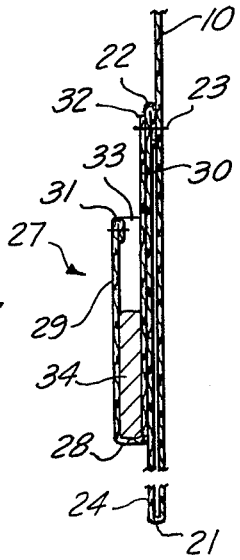
FIG. 3
FIG. 4
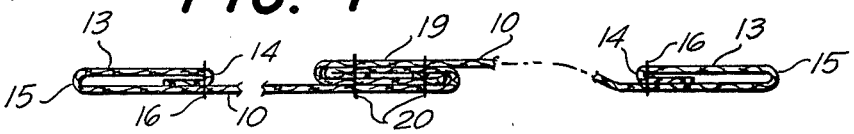

WINDOW CURTAIN HAVING WEIGHT-RECEIVING POCKETS

This invention relates to window curtains, and more particularly to window curtains provided with weighted bottoms.

It has been common practive for many years to provide weights at the bottoms of curtains and draperies so as to cause them to hang properly. Curtain weights have been provided with integral pins for fastening them to curtains. However, the pins of such weights tend to mar the curtain, particularly where it is made of a sheer material.

In some cases, the weights are permanently sewn into, or on to, the bottom hem of the curtain. This avoids marring the curtain material with pins. However, the weights are not removable when the curtain is washed, and as a result they abrade the delicate curtain material during washing.

It is an object of the present invention to overcome these problems by providing a window curtain of sheer fabric having pockets along its lower margin into which weights can be inserted, when the curtain is in use, and from which the weights can readily be removed prior to washing the curtain. Thus, the weights need not be furnished with pins or other fasteners which puncture or otherwise mar the material, but nevertheless weights are securely applied to the curtain and yet are readily removable from it when desired.

It has been suggested in the past to provide a series of pockets along the lower margin of a drapery into which weights can be inserted. However, where a curtain is made of a sheer translucent material, weights arranged along most of the bottom margin of the curtain can be seen through the curtain material, and hence mar the appearance of the curtain. Furthermore, providing pockets along the entire length of the bottom margin involves the use of a large piece of material, which adds to the cost of the curtain. In addition, weights at many points along the bottom margin of the curtain tend to distort sheer curtain material and prevent it from folding evenly.

It is another object of the present invention to overcome these problems by providing pockets for weights only at certain points along the bottom margin of a curtain. More specifically, it has been realized that in the case of sheer curtain, weights are neded only at the lower ends of vertical fabric edges. Concerning the side edges of the curtain panel, weights at the bottoms of these edges keep the bottom of the curtain from flairing outwardly. The side edges of the curtain may simply be the selvedge of the fabric or the curtain panel may be formed with a side hem held in place by vertical stitching. Where a side hem is present, the weight at the lower end of the fabric edge of the hem not only prevents flairing but also pulls downwardly and tends to straighten the vertically stitched region. This is important since the stitching tends to cause stitching takeup or gathering of the curtain fabric. Where the curtain panel is formed of two pieces of material the vertical edges of which are joined along a vertical seam, a weight at the lower end of the seam also serves to straighten out any stitching takeup.

Additional objects and features of the invention will be apparent from the following description in which reference is made to the accompanying drawings.

In the drawings:

FIG. 1 is a perspective view of a window curtain embodying the present invention;

FIG. 2 is an enlarged fragmentary view from the rear of a lower corner of the curtain;

FIG. 3 is a vertical cross-sectional view taken along line 3—3 of FIG. 2; and

FIG. 4 is a fragmentary cross-sectional view taken on line 4—4 of FIG. 1.

The window curtain chosen to illustrate the present invention includes a sheer textile fabric panel 10 hemmed at 11 along its upper margin. In this example, the curtain is also formed with conventional pinch pleats 12 at spaced points along the upper margin. The curtain is hung by means of pins inserted into the rear of the pinch pleats, and the pinch pleats also cause the curtain to hang in soft rolling folds, i.e., they give the curtain an undulating cross-sectional shape.

The invention relates to curtains formed of sheer material, i.e., material which is thin and translucent. Such curtains dress the window and give a degree of privacy, but permit outside light to enter the room. With this in mind; curtain 10 is primarily a single layer of material.

Along its side edges, curtain panel 10 is formed with vertical side hems 13 (see FIGS. 1, 2, and 4). The hems are formed by folding each side margin of the panel vertically upon itself; in this case two such folds are made at 14 and 15. The multilayer hem 13 is then stitched together by a vertical line of stitching 16. Alternatively, the curtain panel could have no side hems; but simply terminate in a selvedge at each side edge.

The curtain panel 10 could be formed of a single piece of material, but in this example, for additional width, two pieces of material, joined along a vertical seam 19, are employed. As illustrated in FIG. 4, seam 19 may be formed by folding the side margins adjacent the opposed edges of the two pieces of material upon themselves, interlocking the folds, and stitching them together by one or more vertical lines of stitching 20.

The bottom margin of panel 10 is folded upon itself along a horizontal fold line 21 (FIGS. 1–3), folded again along a horizontal fold line 22, and then stitched by a horizontal line of stitching 23 to the body of panel 10, to form the bottom hem 24 of the curtain.

A number of pockets 27 are fixed to curtain panel 10. In this example three such pockets are shown, each associated with vertical fabric edges. Two of the pockets are in substantial registry with the edges of hems 13 along which stitching 16 is located. The third pocket is in registry with the two edges forming part of seam 19. Each pocket may be formed of a single strip of fabric, preferably of the same type used to fabricate panel 10, folded upon itself along a horizontal line 28 to define two superposed layers 29 and 30. The layers are stitched together or otherwise joined along their side edges, but are not joined along their top edges 31 and 32. Thus, an opening 33 (FIG. 3) remains along top edge 31 through which access is available to the interior of pocket 27. A weight, in this case a metal disk 34, can be inserted into, and removed from, the pocket through access opening 33. Along the upper edge 32 of the pocket, the latter is stitched or otherwise fastened to panel 10. This stitching may coincide with stitching 23 of bottom hem 24, but in any case no part of pocket 27 extends above the upper edge 22 of hem 24.

In curtains of sheer material, vertical stitching, such as 16 and 20, tends to cause stitching takeup, or gathering, of the material. Weights at the bottoms of these vertical stitched areas 13 and 19 serve to pull taut the stitching takeup. Furthermore, pockets 27 and weights 34 located at the bottoms of vertical areas 13 and 19 are hidden from view even with curtains of sheer material. The reason is that each pocket 27 is hidden behind at least two layers of fabric. When no side hems are provided, the bottom hem 24 and the body of the curtain panel create a double layer thickness of material. In this example, at each lower corner of panel 10, at the bottom of side hems 13, the combined side hem and bottom hem provide at least four layers of material in front of each pocket 27. At the bottom of seam 19, the combined seam and bottom hem also provide at least four layers of material in front of pocket 27. Four superposed layers of even a sheer fabric render the fabric sufficiently opaque to obscure the pocket and its weight.

Pockets and weights are not provided in areas other than in registry with vertical fabric edges mentioned above, because they would show through the curtain in such areas. Also, with sheer material, a weight not in registry with a vertical fabric edge which is either a selvedge, or a stitched area, has the effect of distorting the thin, relatively weak material, and of preventing uniform undulation of the curtain.

The invention has been shown and described in preferred form only, and by way of example, and many variations may be made in the inventon which will still be comprised within its spirit. It is understood, therefore, that the invention is not limited to any specific form or embodiment except insofar as such limitations are included in the appended claims.

What is claimed is:

1. A window curtain comprising:

(a) a sheer textile fabric panel, said panel being a single layer of material throughout most of its area, and said panel having a plurality of vertical fabric edges extending for the full vertical height of said panel, (b) a pocket fixed to said panel near the lower end of each vertical fabric edge, each pocket being made of material forming no part of the remainder of the curtain and having an opening through which access is available to the interior of the pocket, said pockets being in registry only with said vertical fabric edges and the remainder of said panel being devoid of pockets and (c) a weight located within each pocket, said weight being readily removable from its respective pocket through said access opening, and said weight being devoid of securing means so that said pocket is the sole means mounting said weight on said panel.

2. A window curtain as defined in claim 1 wherein said panel is formed of a translucent fabric.

3. A window curtain as defined in claim 1 wherein said panel has side hems, each hem comprising a side margin of said panel adjacent to one of said vertical fabric edges folded vertically upon itself, and each side hem being stitched together by a line of vertical stitching.

4. A window curtain as defined in claim 1 wherein said panel includes two pieces of material joined together along a vertical seam, said seam comprising two adjacent vertical margins of said pieces arranged in an overlapped relationship, each margin being adjacent to one of said vertical fabric edges, and said seam being stitched together by a line of vertical stitching.

5. A window curtain as defined in claim 1 wherein said panel has a bottom hem comprising the bottom margin of the panel folded horizontally upon itself, said pockets being located no higher than the upper edge of said bottom hem.

6. A window curtain as defined in claim 1 wherein each pocket comprises two layers of fabric joined together along their bottom and said edges but unconnected along their top edges, said access opening being defined by said unconnected top edges.

7. A window curtain comprising:

(a) a translucent textile fabric panel, said panel being a single layer of material throughout most of its area, (b) a plurality of vertical fabric edges extending for the full vertical height of said panel, (c) a bottom hem on said panel comprising the bottom margin of the panel folded horizontally upon itself, (d) a pocket fixed to said panel near the lower end of each vertical fabric edge, each pocket being made of material forming no part of the remainder of the curtain and having an upwardly facing opening through which access is available to the interior of the pocket, said pockets being in registry only with said vertical fabric edges and the remainder of said panel being devoid of pockets, and said pockets being located no higher than the upper edge of said bottom hem, and (e) a weight located within each pocket, said weight being readily removable from its respective pocket through said access opening, and said weight being devoid of securing means so that said pocket is the sole means mounting said weight on said panel.

8. A window curtain as defined in claim 7 wherein said panel includes two pieces of material joined together along a vertical seam, said seam comprising two adjacent vertical margins of said pieces arranged in an overlapped relationship, each margin being adjacent to one of said vertical fabric edges, and said seam being stitched together by a line of vertical stitching.

9. A window curtain as defined in claim 7 wherein said panel has side hems, each side hem comprising a side margin of said panel adjacent to one of said vertical fabric edges folded vertically upon itself, and each side hem being stitched together by a line of vertical stitching.

* * * * *